US007735214B2

(12) United States Patent
Wu et al.

(10) Patent No.: US 7,735,214 B2
(45) Date of Patent: Jun. 15, 2010

(54) METHOD FOR MANUFACTURING METALLIC KEYPAD PANEL HAVING RIPPLE LUSTER

(75) Inventors: Che-Tung Wu, Taoyuan (TW); Chih-Ho Hsu, Taoyuan (TW); Kai-Jie Tsao, Taoyuan (TW)

(73) Assignee: Ichia Technoligies, Inc., Taoyuan (TW)

( * ) Notice: Subject to any disclaimer, the term of this patent is extended or adjusted under 35 U.S.C. 154(b) by 434 days.

(21) Appl. No.: 11/946,584

(22) Filed: Nov. 28, 2007

(65) Prior Publication Data

US 2009/0320276 A1 Dec. 31, 2009

(30) Foreign Application Priority Data

Nov. 7, 2007 (TW) ..... 96142046 A

(51) Int. Cl.
*H01H 11/00* (2006.01)
*H01H 65/00* (2006.01)

(52) U.S. Cl. ..... 29/622; 29/846; 29/848; 29/874; 29/876; 29/881; 200/302.2; 200/314; 200/341

(58) Field of Classification Search ..... 29/622, 29/846, 848, 874, 876, 881–883; 200/302.2, 200/314, 341, 5 A, 512, 514
See application file for complete search history.

(56) References Cited

U.S. PATENT DOCUMENTS 6,196,738 B1 * 3/2001 Shimizu et al. ..... 400/490
6,462,294 B2 * 10/2002 Davidson et al. ..... 200/512

FOREIGN PATENT DOCUMENTS

JP 2007-115633 5/2007

* cited by examiner

*Primary Examiner*—Thiem Phan
(74) *Attorney, Agent, or Firm*—Chun-Ming Shih

(57) ABSTRACT

A metallic thin plate is etched to form a plurality of keypads having hollowed portions and cut to form a metallic keypad panel having a predetermined shape. Then, an electroplated layer is coated on the surface of the metallic keypad panel. A layer of protective film is adhered on the non-electroplated surface of the metallic keypad panel, which is disposed in a mold. A plastic material is then injected into the mold, so that the plastic material is formed into a pattern layer. In addition, a plastic thin plate is prepared with one side surface printed with a displaying layer, is adhered on elastic bodies having a plurality of protrusions and is cut to form an elastic layer. Finally, after the protective film is peeled off, an adhesive layer is applied thereon. The elastic layer is adhered on the surface of the adhesive layer.

19 Claims, 18 Drawing Sheets

METHOD FOR MANUFACTURING METALLIC KEYPAD PANEL HAVING RIPPLE LUSTER

BACKGROUND OF THE INVENTION

1. Field of the Invention

The present invention relates to a keypad panel, and in particular to a method for manufacturing a metallic keypad panel.

2. Description of Prior Art

Keypad panel has become a necessary hardware for a portable electronic device. The surface of the keypad on the keypad panel is provided with numerals, characters, phonetic symbols, roots for an input method and various functional icons, so that a user can input data according to the icon displayed on the surface of the keypad or perform various functions of the portable electronic device. Therefore, for a portable electronic device, the keypad panel is a very important input means.

For example, a conventional metallic keypad panel on a portable electronic device is shown in FIGS. 1(*a*) and 1(*b*) (Japanese Laid-Open Patent Publication No. 2007-115633). In manufacturing the metallic keypad panel 10*a* disclosed in FIG. 1, a metallic plate 1*a* is prepared first. Then, a first etching process is applied to the metallic plate 1*a*, thereby forming hollowed portions 2*a* having characters, numerals and marks. After etching the hollowed portions 2*a*, a second etching process is applied to one side surface of the metallic plate 1*a*. After the second etching process, one side surface of the metallic plate 1*a* is formed thereon with a cross-like recessed portion 2*b*. Then, the metallic plate 1*a* is disposed in a mold. A resin is injected into the mold, so that the resin can fill the hollowed portions 2*a* and the cross-like recessed portion 2*b*. The cross-like recessed portion 2*b* allows the resin to be combined on the metallic plate 1*a* firmly, thereby forming a resin layer 3*a*. After the metallic plate 1*a* is combined with the resin layer 3*a*, the metallic plate 1*a* is cut to form keypad caps 11*a*. Then, one side surface of the resin layer 3*a* is printed with a printing layer 4*a*. An adhesive layer 5*a* is applied on the printing layer 4*a*. The resin layer 3*a* is adhered on elastic bodies 7*a* of a base 6*a*, so that a protrusion 71*a* of the elastic body 7*a* can press against a metal dome 8.

In manufacturing the above-mentioned metallic keypad panel 10*a*, since two or more etching processes should be applied to the metallic plate 1*a*, more work hours and a large number of processes are necessary. Further, a gap is formed between each keypad cap 11*a*, and the gap may be filled with dusts or penetrated by liquid easily. As a result, the metallic keypad caps 11*a* cannot be pressed smoothly or an internal short circuit may occur. Further, one side surface of the metallic plate 1*a* does not provide any reflective effect of a particular luster. Therefore, the external appearance and the overall visual effect of the metallic keypad panel 10*a* are dull.

SUMMARY OF THE INVENTION

In view of the above drawbacks, the present invention is to provide a novel and simple method for manufacturing a metallic keypad panel that allows the metallic keypad panel to be manufactured easily while making the surface of the metallic keypad panel to have a reflective effect of a ripple luster.

The present invention is to provide a method for manufacturing a metallic keypad panel having a ripple luster. First, a metallic thin plate is prepared. The metallic thin plate is subjected to an etching process, thereby forming keypads having a plurality of hollowed portions on the metallic thin plate. After cutting the etched metallic thin plate having the hollowed portions, a keypad panel having a predetermined shape is formed. Then, the completely cut keypad panel is subjected to an electroplating process in an electroplating tank, thereby coating an electroplated layer on the surface of the keypad panel. After the electroplating of the metallic keypad panel is completed, a layer of protective film is adhered on the non-electroplated surface of the metallic keypad panel. Then, the metallic keypad panel adhered with the protective film is disposed in a mold. A plastic material such as TPU or TPE is injected into the mold, so that the plastic material can be attached on the surface of the electroplated layer and the hollowed portion. Further, the pattern on the inner surface of the mold makes the plastic material to form a pattern layer accordingly. In addition, a plastic thin plate is prepared. One side surface of the plastic thin plate is printed with a displaying layer. The plastic thin plate is adhered on elastic bodies having a plurality of protrusions. The plastic thin plate is cut to form an elastic layer. Finally, after the protective film on one side surface of the metallic keypad panel is peeled off, an adhesive layer is applied thereon. The elastic layer is adhered on the adhesive layer. Via the above steps, the manufacturing of the metallic keypad panel is completed.

BRIEF DESCRIPTION OF THE DRAWINGS

FIG. 5(*b*) is a schematic view showing an operating state in which the metallic keypad panel of the present invention is used in a circuit board of an electronic device;

DETAILED DESCRIPTION OF THE INVENTION

The detailed description and the technical contents of the present invention will be explained with reference to the accompanying drawings.

Figure 1A:
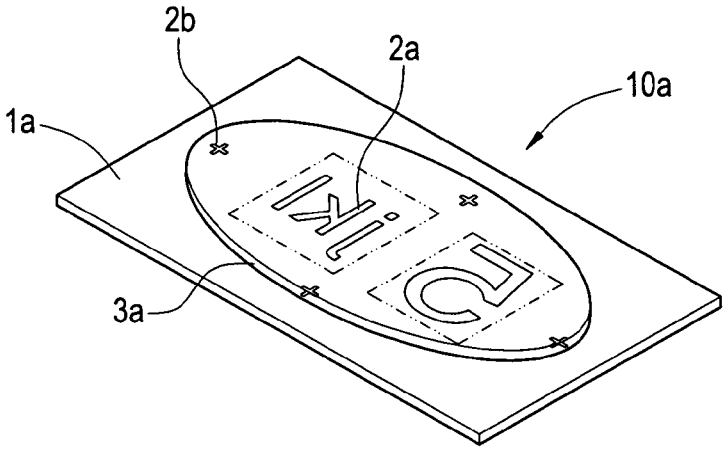
FIG.1a PRIOR ART
FIGS. 1(*a*) and 1(*b*) are schematic views showing a structure of a traditional metallic keypad panel.
Figure 1B:
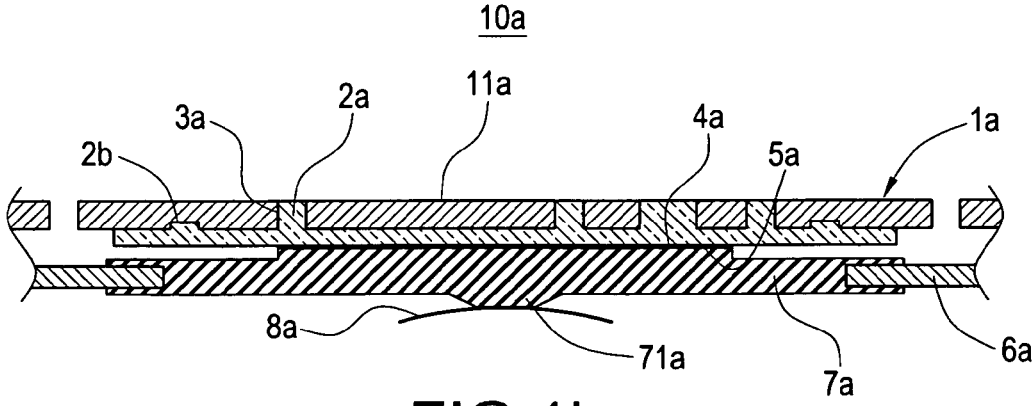
FIG.1b PRIOR ART
Figure 2:
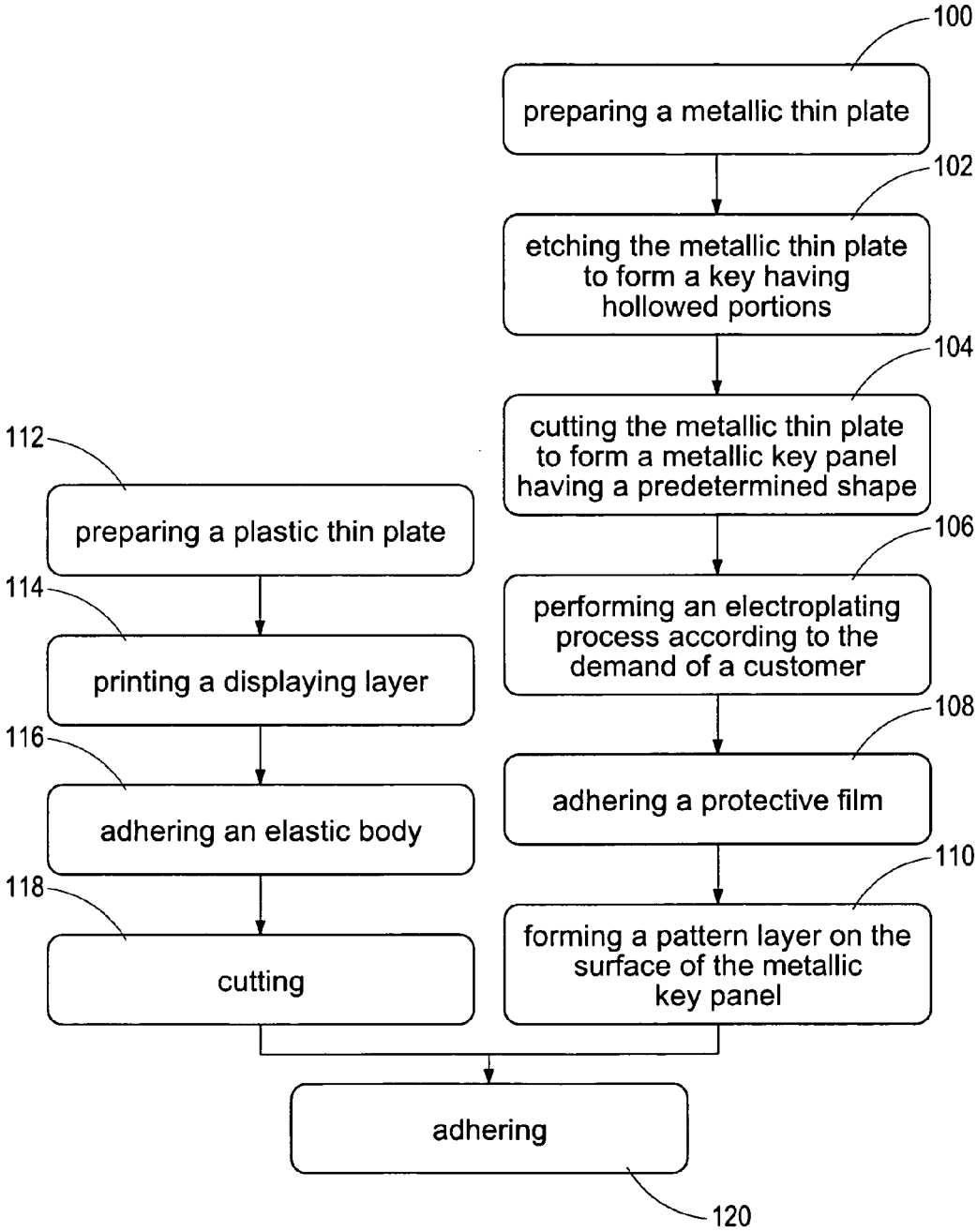
FIG. 2 is a schematic view showing the procedure for manufacturing a metallic keypad panel of the present invention.
Figure 3A:
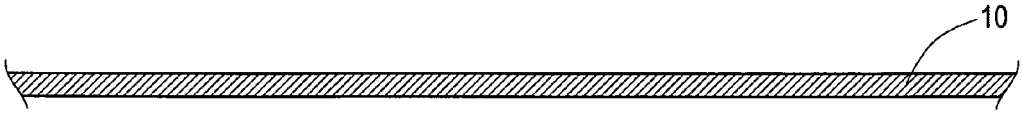
FIGS. 3(*a*) to 3(*j*) are structural views showing the procedure for manufacturing a metallic keypad panel of the present invention.
Figure 3B:
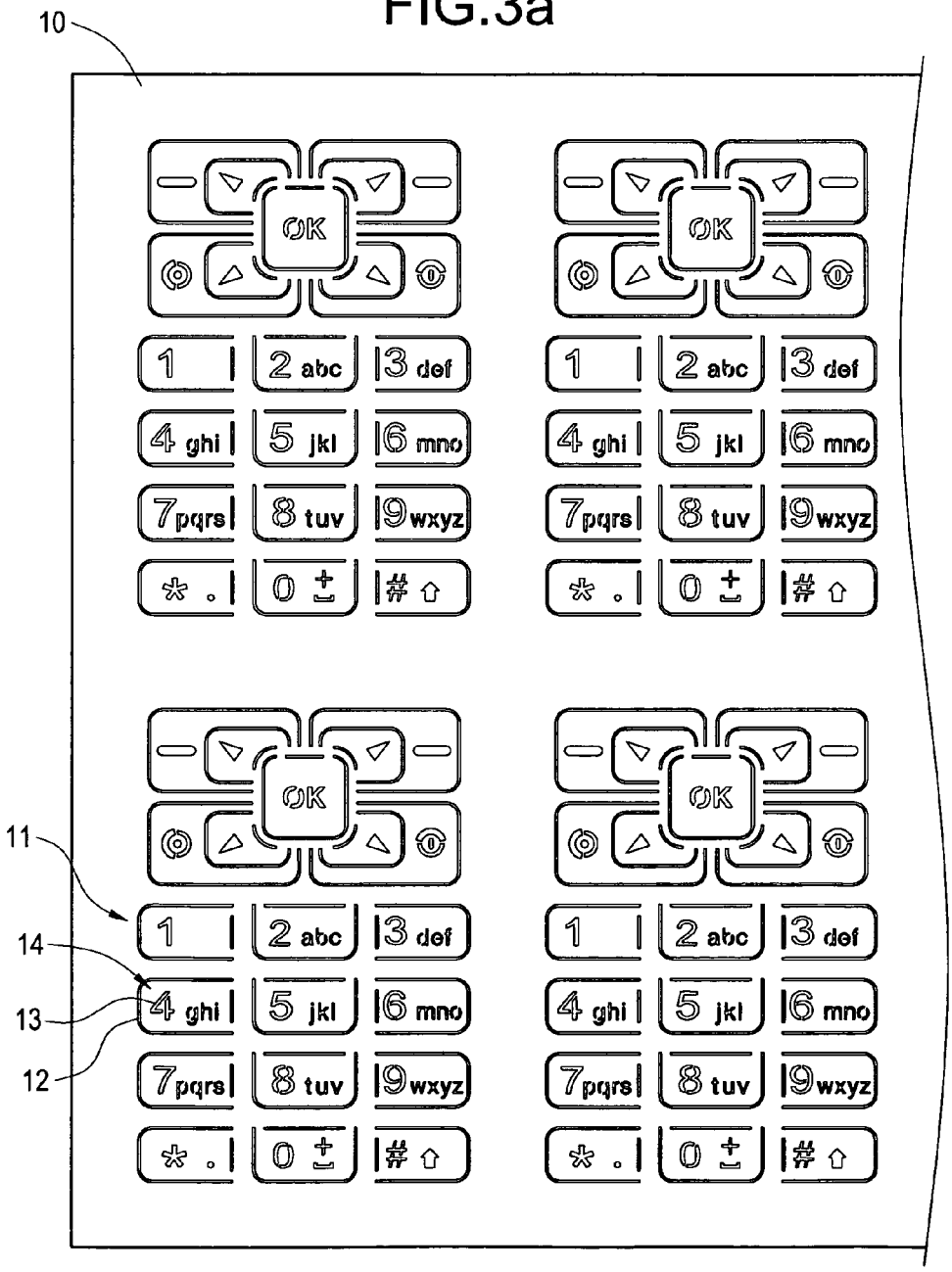
Figure 3C:
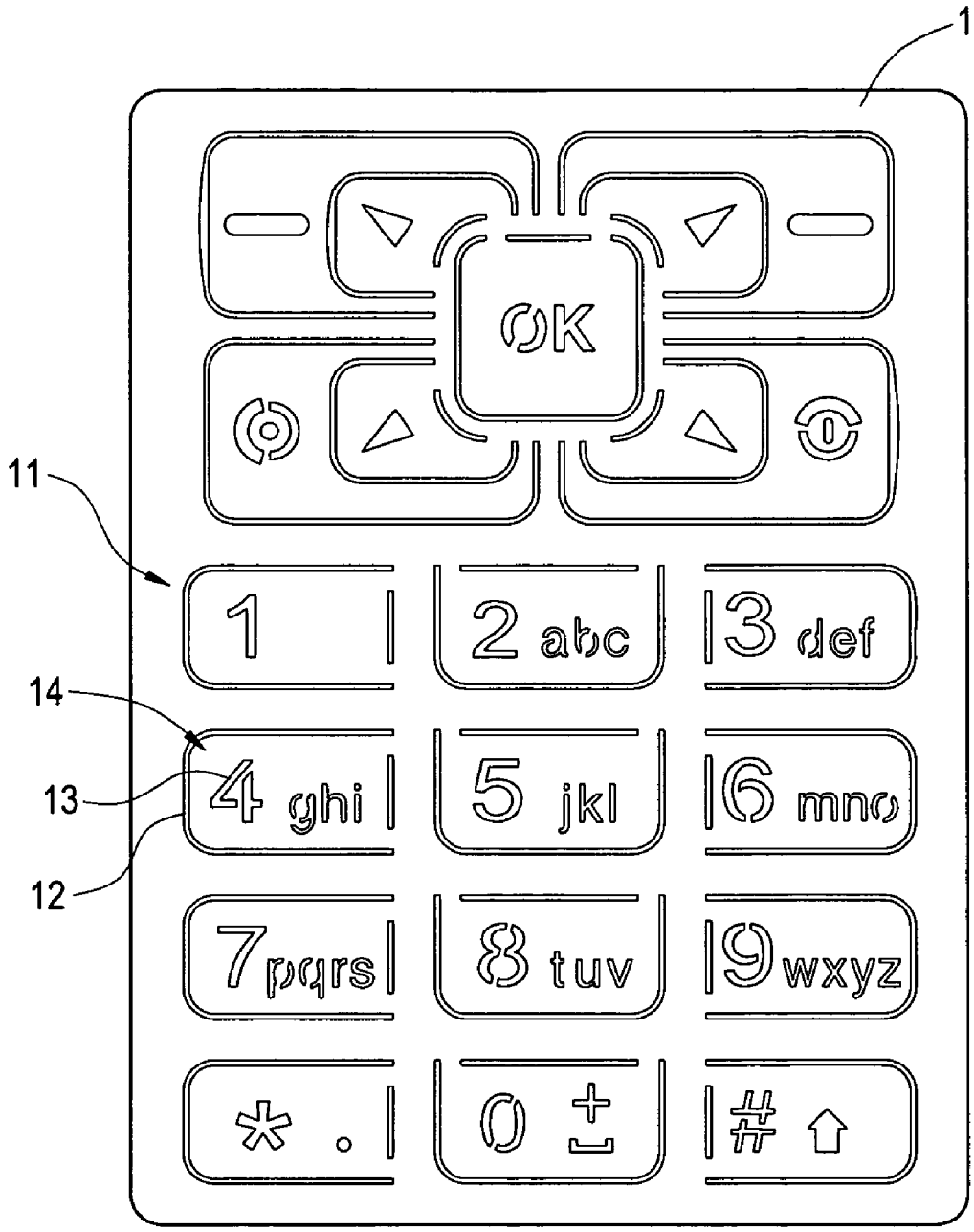
Figure 3D:
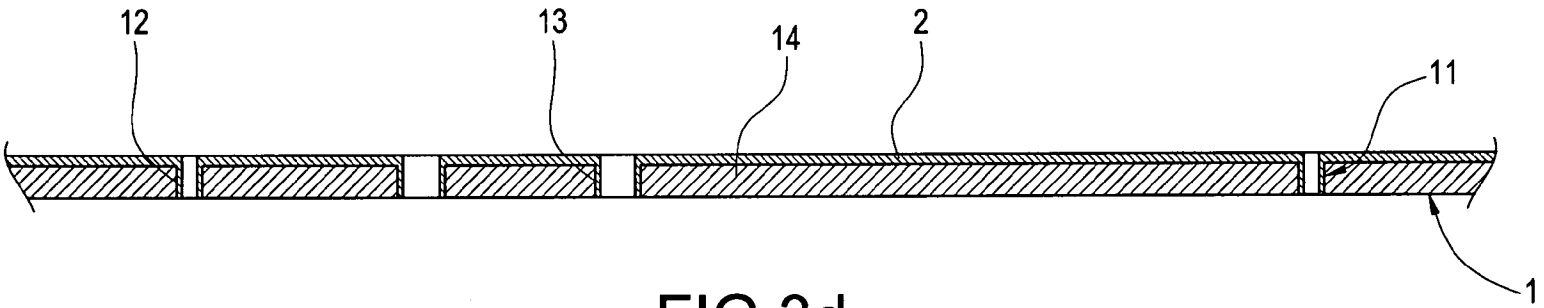
Figure 3E:
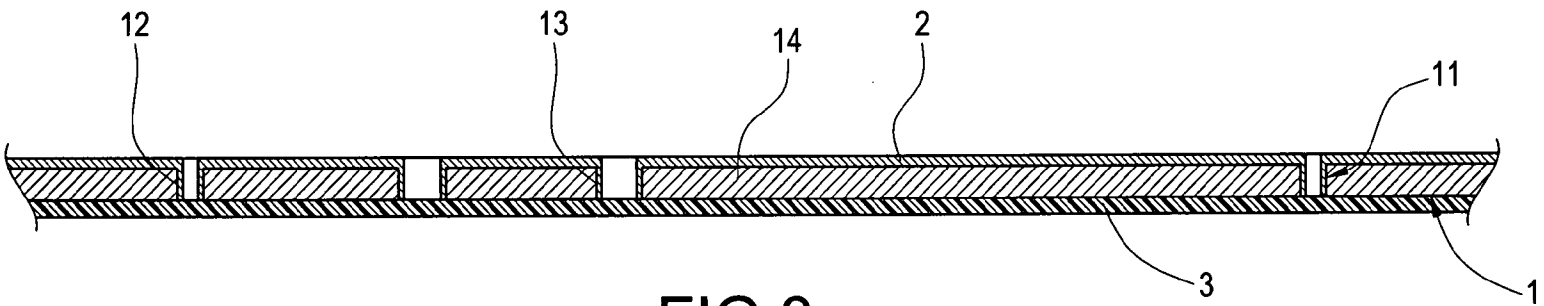
Figure 3F:
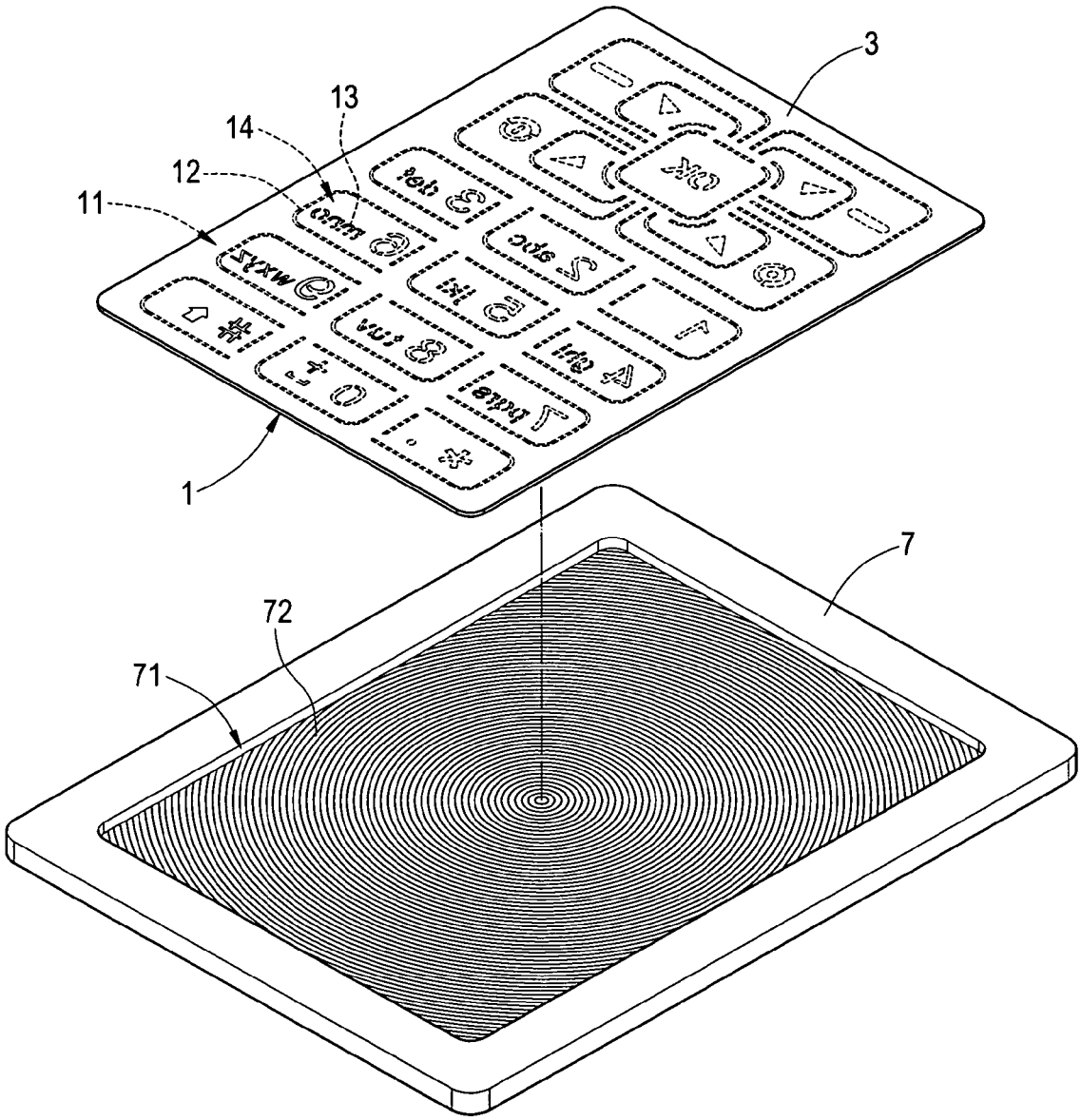
Figure 3G:
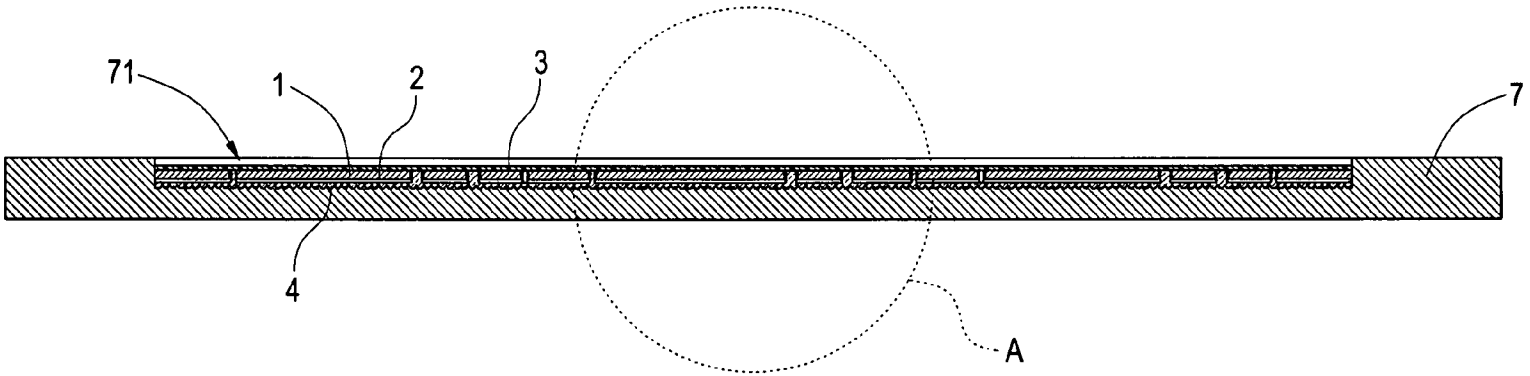
Figure 3H:
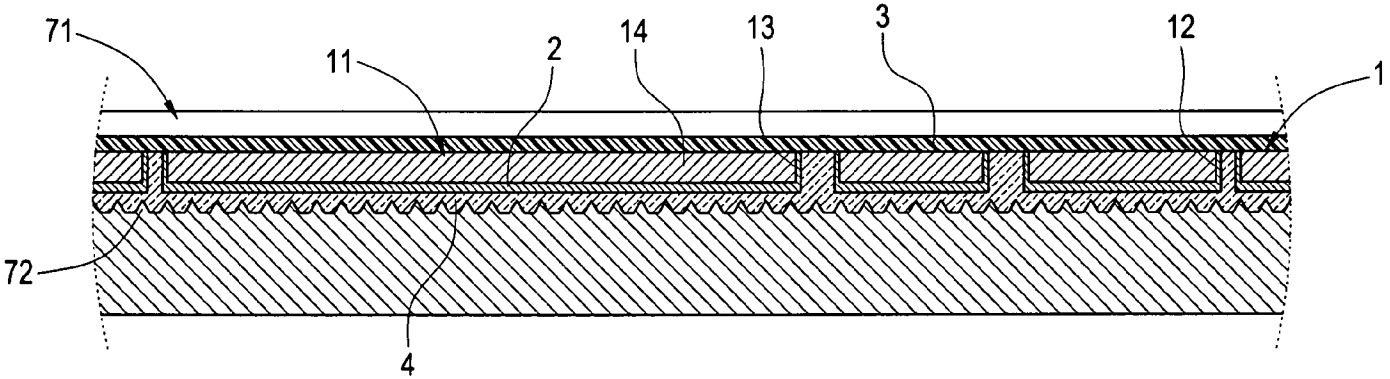
Figure 3I:
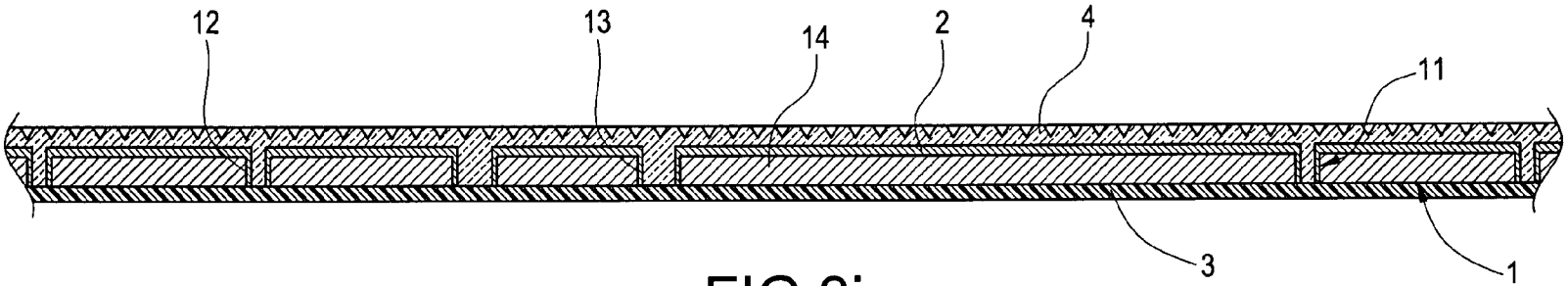
Figure 3J:
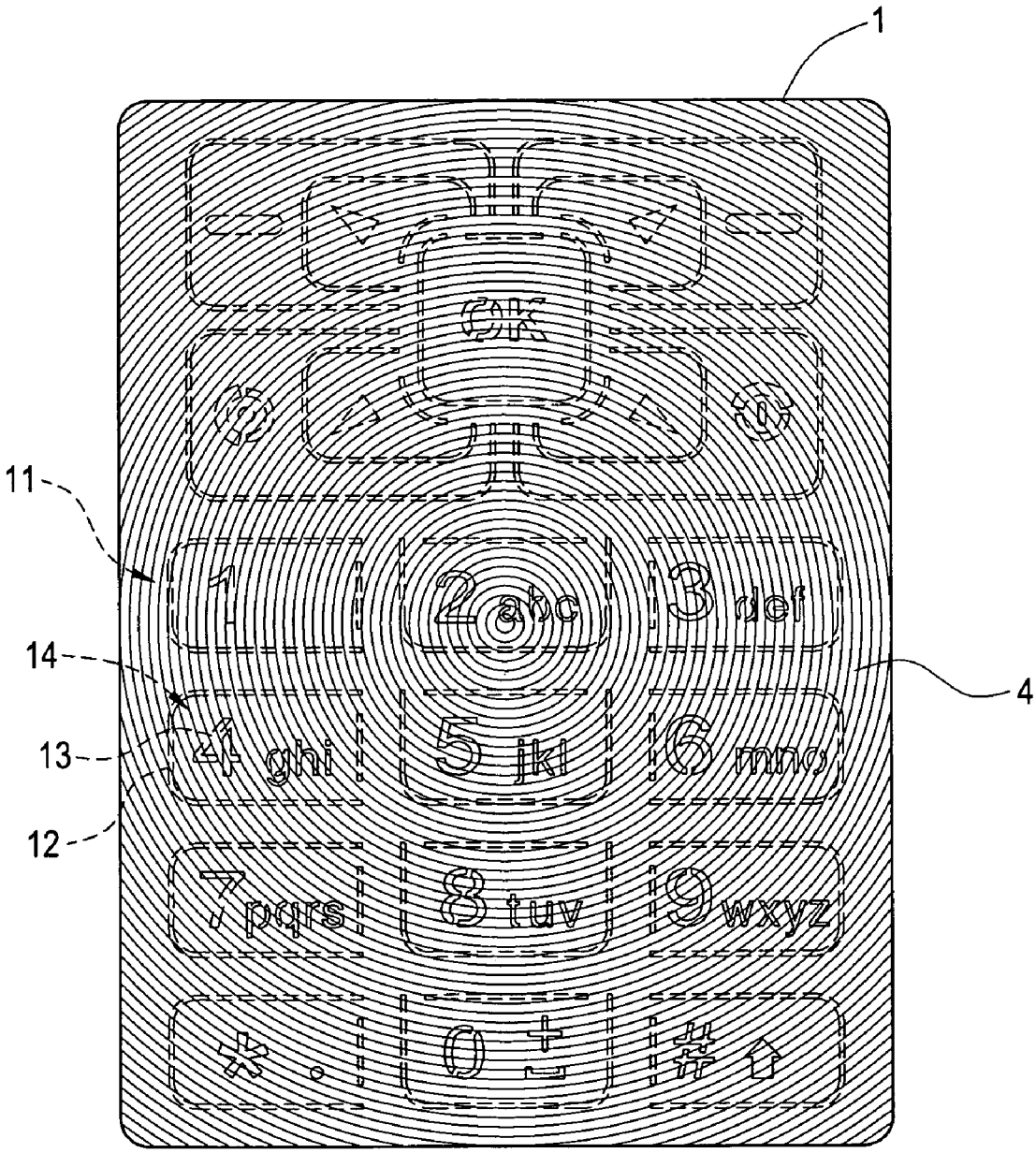
Figure 4A:
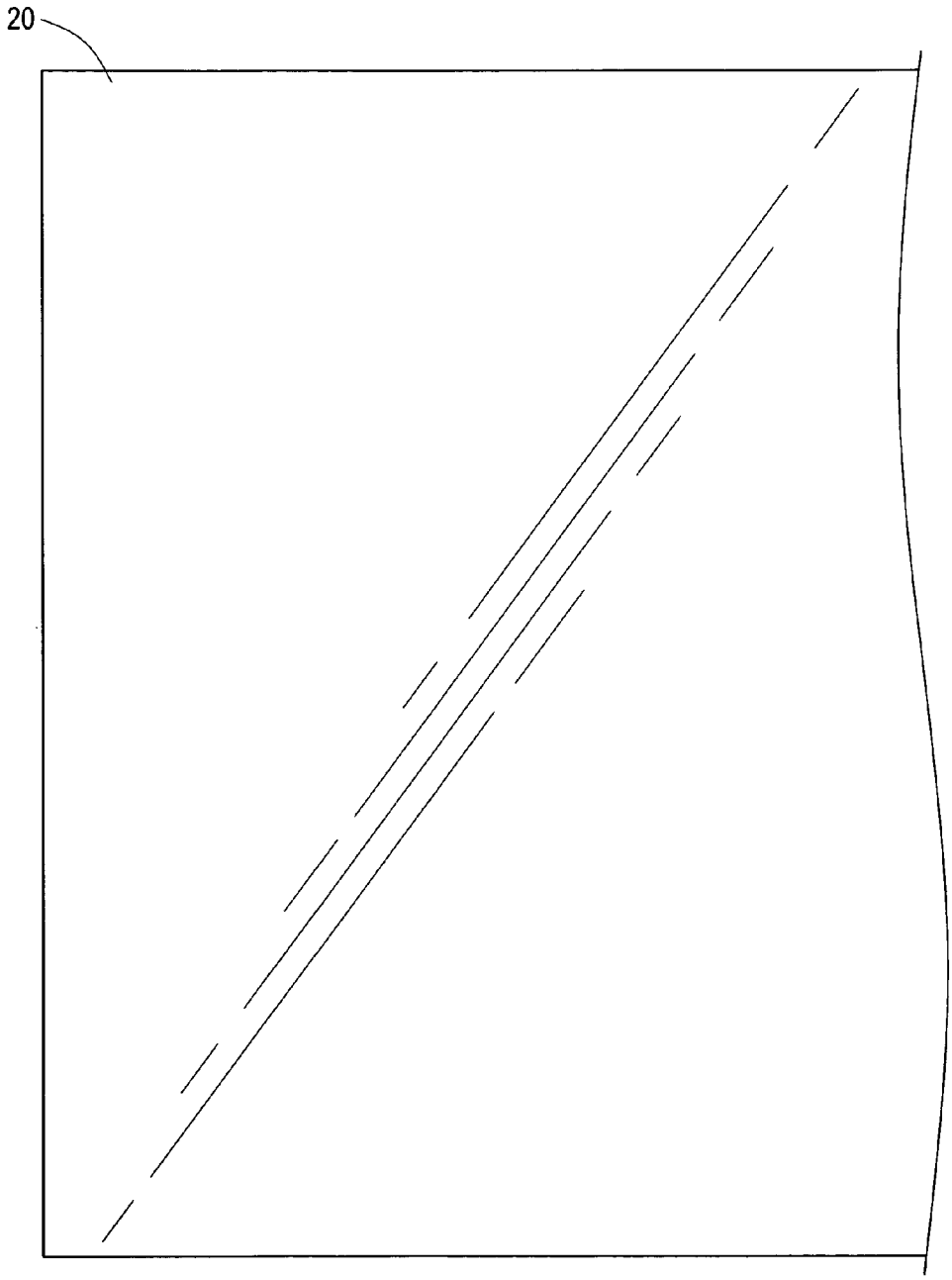
FIGS. 4(*a*) to 4(*g*) are structural views showing the procedure for manufacturing an elastic layer of the present invention.
Figure 4B:
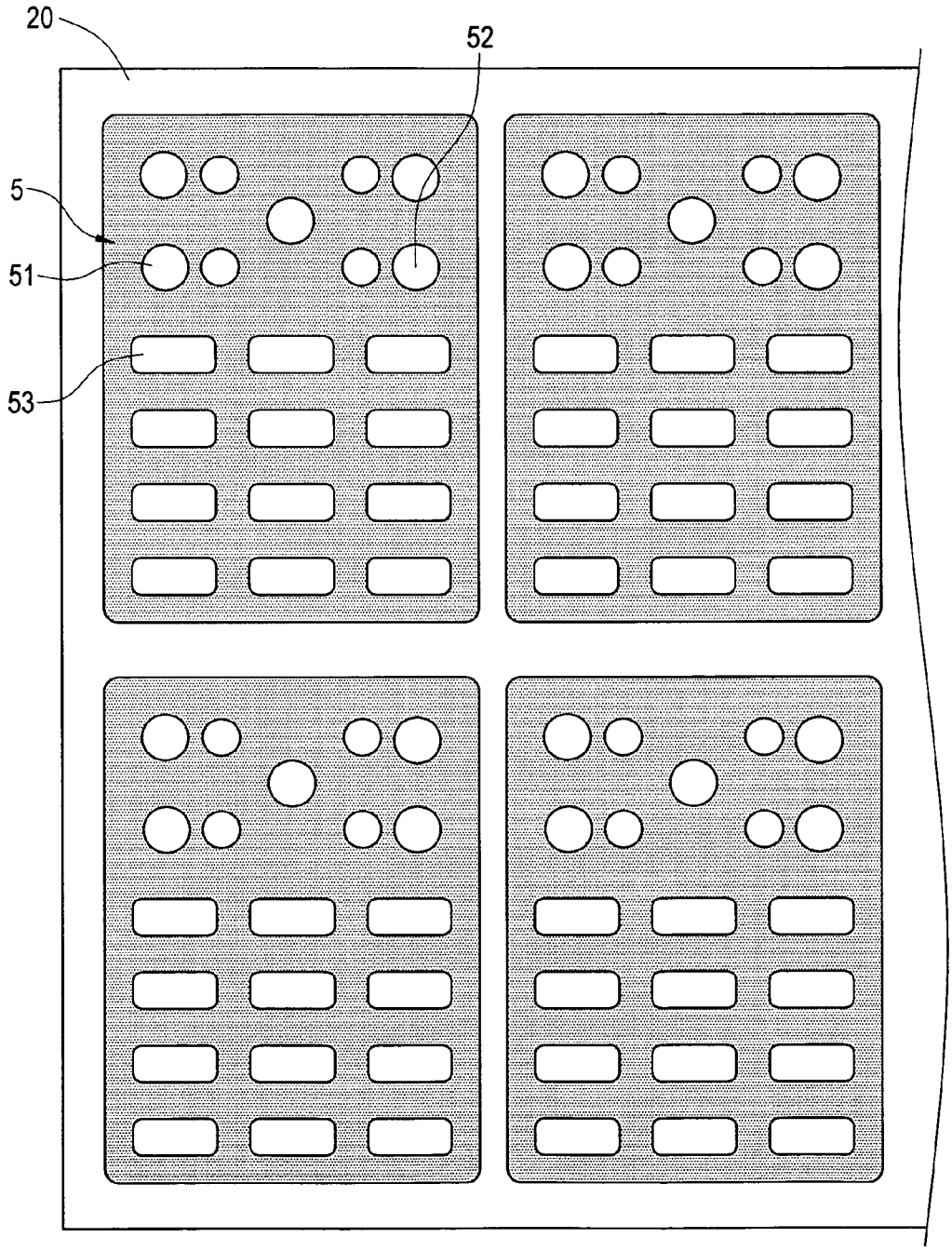
Figure 4C:
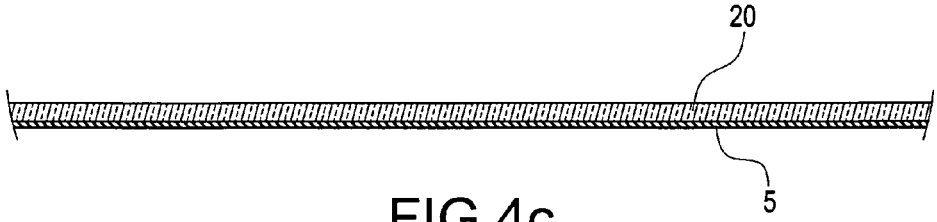
Figure 4D:
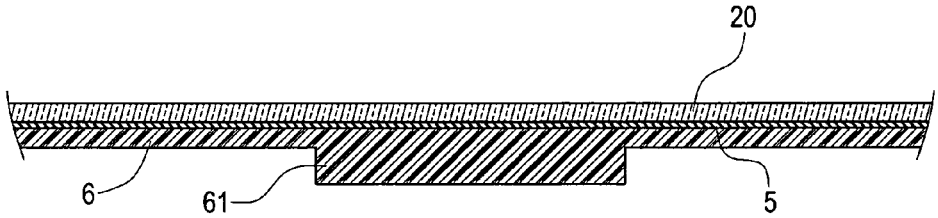
Figure 4E:
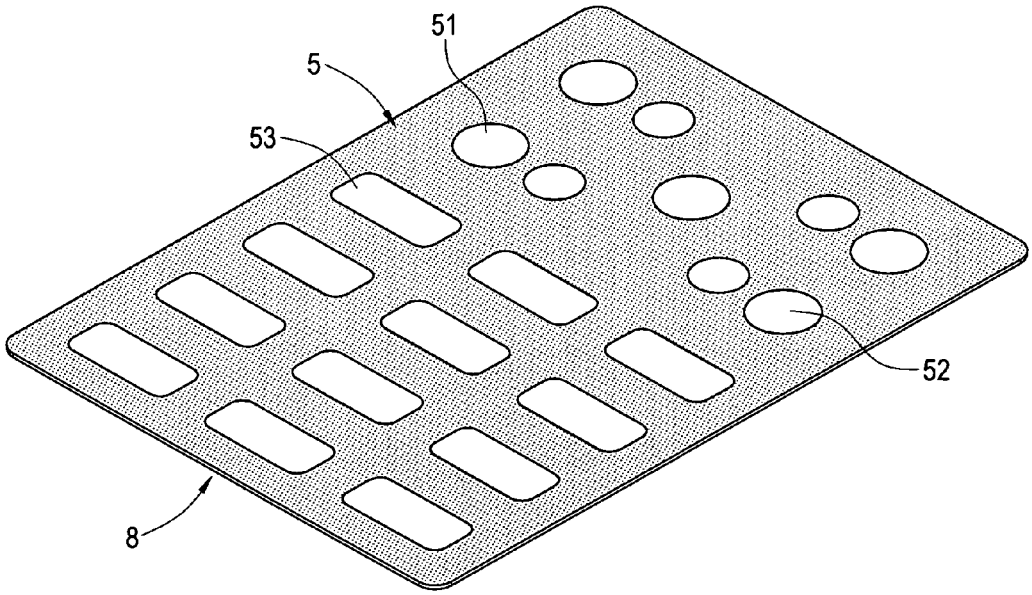
Figure 4F:
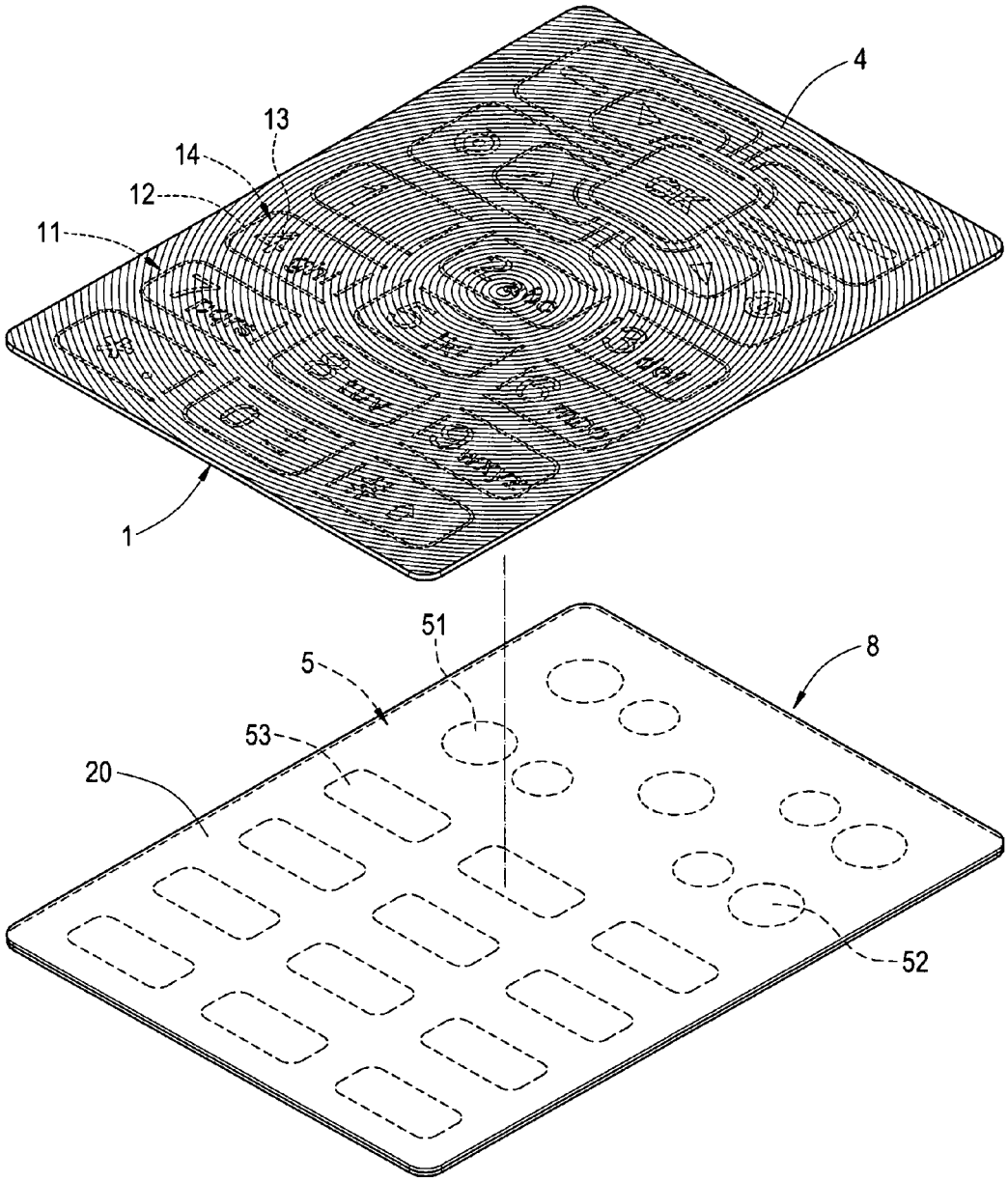
Figure 4G:
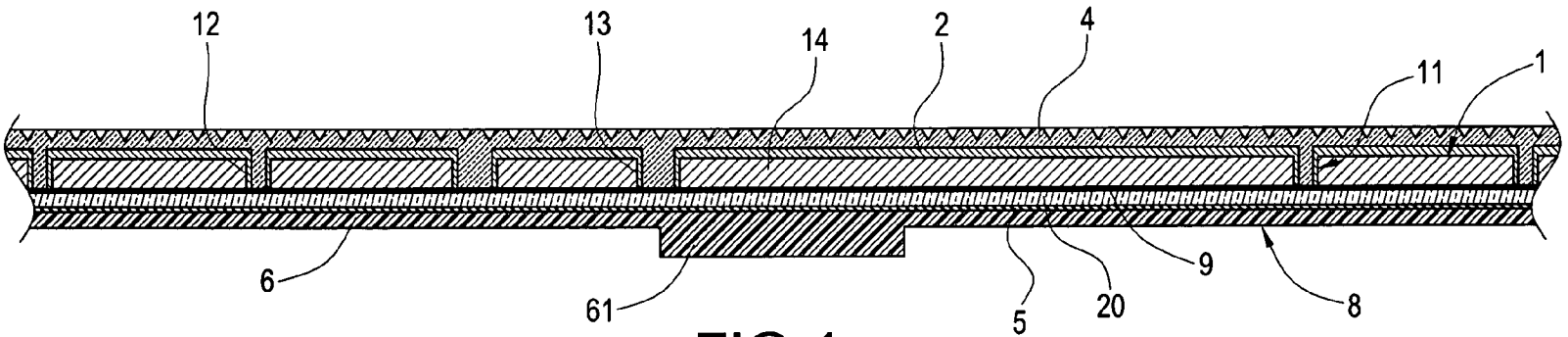

With reference to FIG. 2, it is a schematic view showing the procedure for manufacturing a metallic keypad panel of the present invention. As shown in this figure, the present invention provides a method for manufacturing a metallic keypad panel having a ripple luster. In manufacturing the metallic keypad panel (please also refer to FIGS. 3 and 4), first, in a step 100, a metallic thin plate 10 is prepared as shown in FIG. 3(*a*). The metallic thin plate 10 is made of stainless steel (SUS) or Al—Mg alloy.

In a step 102, an etching process is performed. The metallic thin plate 10 is subjected to the etching process, so that the metallic thin plate 10 is formed thereon with a plurality of hollowed portions 11. The hollowed portions 11 are classified into line-type hollowed portions 12 and icon-type hollowed portions 13. The line-type hollowed portion 12 is used to define a pressing region 14 of a keypad, and the second hollowed portion 13 is set as an icon on the surface of the pressing region 14. As shown in FIG. 3(*b*), the icons include numerals (0 to 9), characters (A to Z), special symbols (e.g., "#", "*", "." dialing icon, ending icon and etc.), and navigational symbols.

In a step 104, a cutting process is performed. The etched metallic thin plate 10 having the hollowed portions 11 is cut to form a metallic keypad panel 1 having a predetermined shape, as shown in FIG. 3(*c*).

In a step 106, an electroplating process is performed. The completely cut metallic keypad panel 1 is electroplated in an electroplating tank, thereby forming an electroplated layer 2 on the surface of the metallic keypad panel 1 and the wall face of the hollowed portion 11, as shown in FIG. 3(*d*). According to the demand of a customer, the electroplated layer 2 can be processed to coat a layer of metallic material such as nickel on the surface of the metallic keypad panel 1.

In a step 108, a protective film is adhered. After the electroplating process of the metallic keypad panel 1 is completed, as shown in FIG. 3(*e*), a layer of protective film 3 is adhered on the non-electroplated surface of the metallic keypad panel 1. Thereby, in subsequent processes, the non-electroplated surface of the metallic keypad panel 1 can be prevented from suffering contamination or damage.

In a step 110, the metallic keypad panel 1 adhered with the protective film 3 is disposed in a mold 7. Then, a plastic material such as thermoplastic polyurethane (TPU) or thermoplastic elastomer (TPE) is injected into a cavity 71 of the mold 7, so that the plastic material (TPU or TPE) can be adhered on the surface of the electroplated layer 2 and the hollowed portion 11. In this way, the pattern 72 on the inner surface of the cavity 71 of the mold 7 makes the plastic material (TPU or TPE) to form a pattern layer 4 as shown in FIGS. 3(*f*) to 3(*j*). The pattern layer 4 is any one of a spinning having a ripple luster, straight lines or an Archimedean screw. Further, the pattern layer 4 forms a protective layer for the metallic keypad panel 1.

In a step 112, a plastic thin plate 20 is prepared. As shown in FIG. 4(*a*), the plastic thin plate 20 is made of polyethylene terephthalate (PET) or polycarbonate (PC).

In a step 114, one side surface of the plastic thin plate 20 is printed with a displaying layer 5. As shown in FIGS. 4(*b*) and 4(*c*), the displaying layer 5 is constituted of different colors, such as green 51, red 52 and white 53.

In a step 116, after an adhesive agent is applied on one side surface of the plastic thin plate 20, a layer of elastic bodies 6 is adhered thereon. The other side surface of the elastic bodies 6 is provided with a plurality of protrusions 61, as shown in FIG. 4(*d*). In the drawings, the elastic body 6 is made of a transparent rubber material.

In a step 120, after the protective film 3 on one surface of the metallic keypad panel 1 is peeled off, one side surface of the metallic keypad panel 1 is coated with an adhesive layer 9. One side surface of the elastic layer 8 is adhered on the adhesive layer 9, so that the metallic keypad panel 1 and the elastic layer 8 are combined with each other, as shown in FIGS. 4(*f*) and 4(*g*). Via the above steps, the manufacturing of the metallic keypad panel 1 is completed.

Figure 5A:
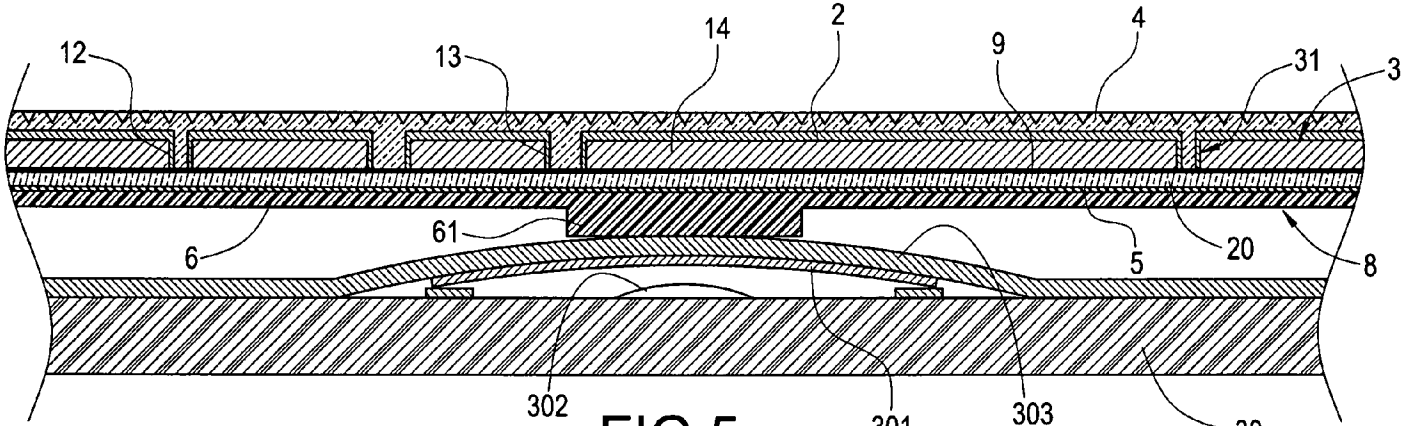
FIG. 5(*a*) is a schematic view showing the metallic keypad panel of the present invention being used in a circuit board of an electronic device.
Figure 5B:
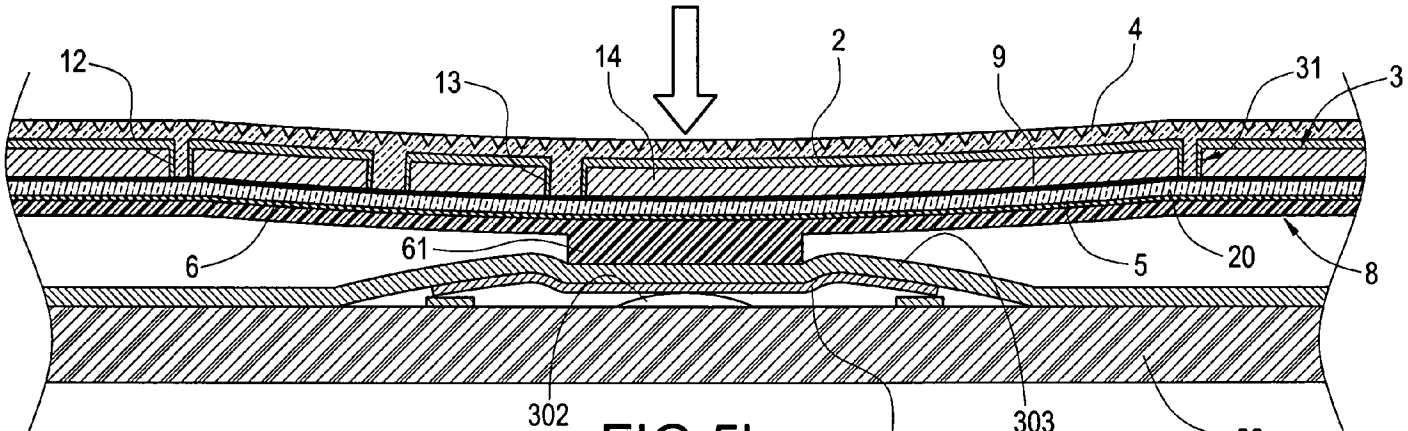

FIG. 5(*a*) is a schematic view showing the metallic keypad panel of the present invention being used in a circuit board of an electronic device, and FIG. 5(*b*) is a schematic view showing an operating state thereof. As shown in these figures, when the metallic keypad panel 1 and the elastic layer 8 of the present invention are arranged on a flexible printed circuit board 30 of an electronic device, the circuit board 30 is provided with a plurality of metal domes 301. Each metal dome 301 corresponds to a contacting point 302 on the circuit board 30. Then, a dome sheet 303 is attached on one side surface of the circuit board 30, so that the metal dome 301 is disposed between the circuit board 30 and the dome sheet 303.

When the pressing region 14 of the metallic keypad panel 1 is pressed by an external force, the pressing of the pressing region 14 causes the protrusion 61 on the elastic body 6 of the elastic layer 8 to press against one side surface of the dome sheet 303. As a result, the metal dome 301 is deformed to contact the contacting point 302 of the circuit board 30, thereby generating a conductive signal output.

When the surface of the pressing region 14 is not pressed by an external force, the elasticity of the materials of the metallic keypad panel 1 and the elastic layer 8 allows the pressing region 14 to rise automatically, thereby returning to its original state.

Further, when a backlight model (not shown) arranged within the electronic device is lighted up, the color displayed by the displaying layer 5 makes the pressing region 14 to exhibit different colors.

Figure 6:
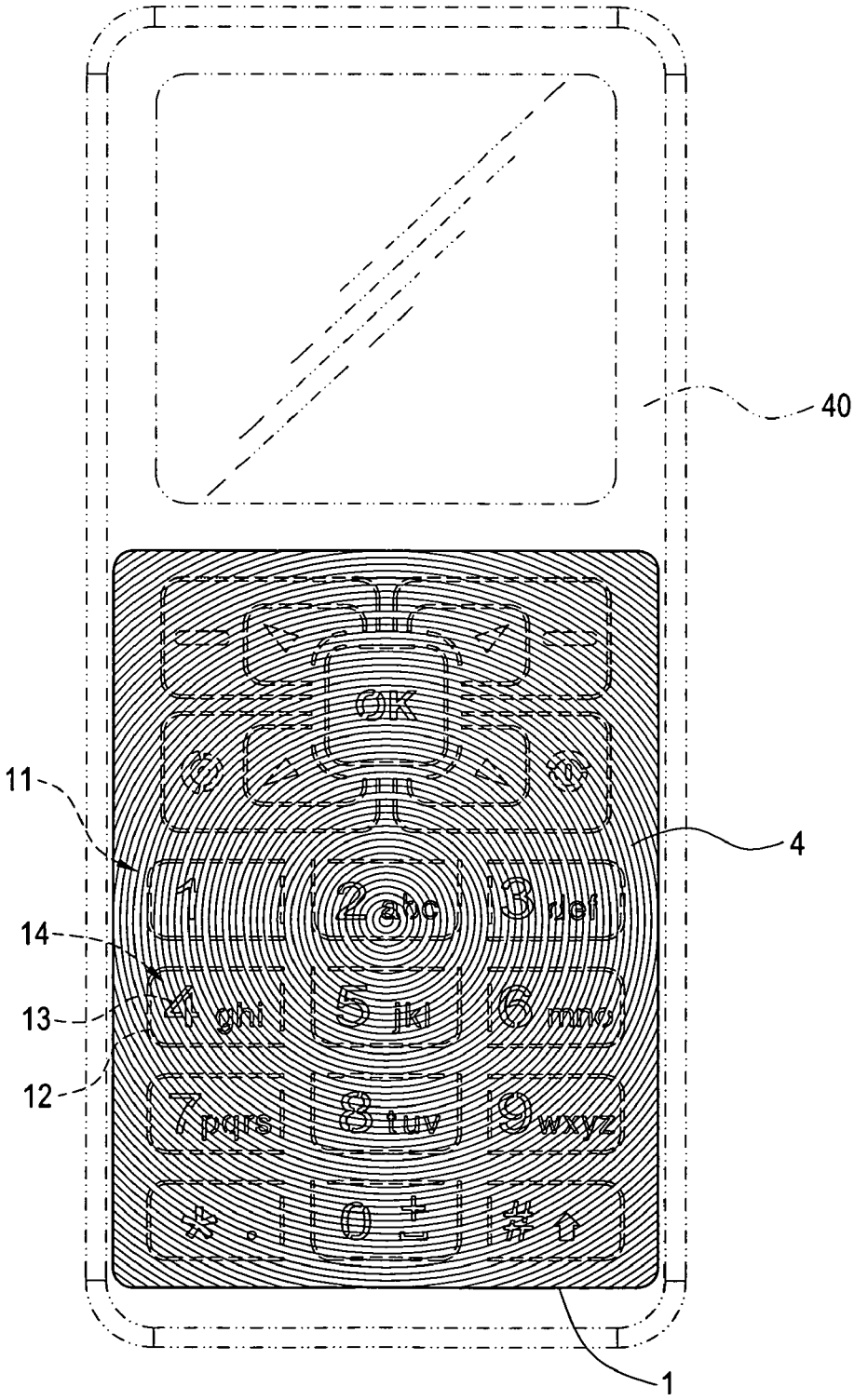
FIG. 6 is a schematic view showing the metallic keypad panel of the present invention being used in a mobile phone.

With reference to FIG. 6, it is a schematic view showing the metallic keypad panel of the present invention being used in a mobile phone. As shown in this figure, after the metallic keypad panel 1 of the present invention is manufactured completely, it can be applied to a mobile phone 40. When the light illuminates the pattern layer 4 of the metallic keypad panel 1, the pattern layer 4 generates a reflective effect of a ripple luster, thereby increasing the aesthetic feeling of the mobile phone 40. Further, the pattern layer 4 can protect the surface of the metallic keypad panel 1 from suffering damage due to external rigid objects.

Figure 7:
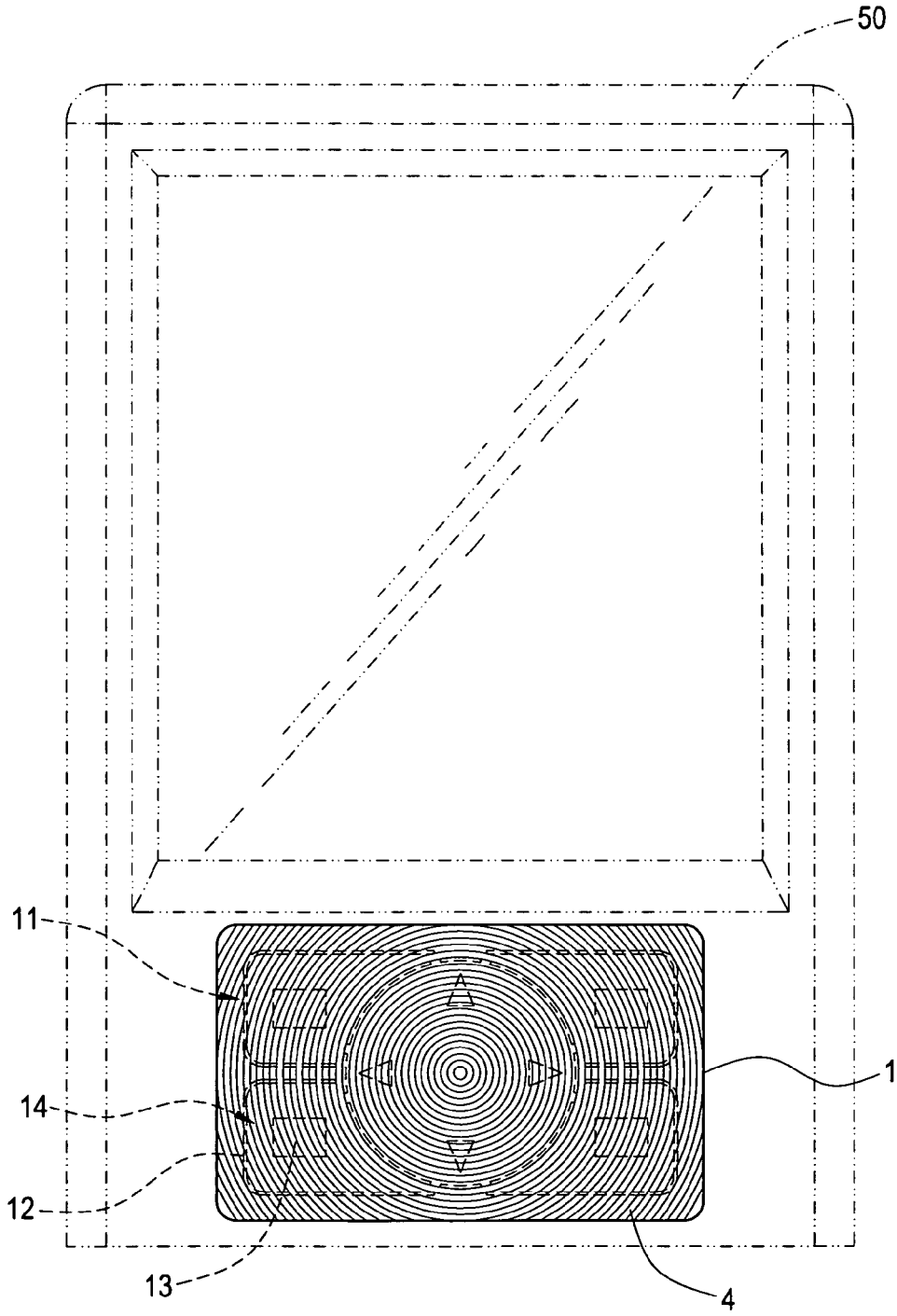
FIG. 7 is a schematic view showing the metallic keypad panel of the present invention being used in a personal digital assistant (PDA)

With reference to FIG. 7, it is a schematic view showing the metallic keypad panel of the present invention being used in a personal digital assistant (PDA). As shown in this figure, after the metallic keypad panel 1 of the present invention is manufactured completely, in addition to the mobile phone 40, it can be applied to a personal digital assistant (PDA) 50. When the light illuminates the pattern layer 4 of the metallic keypad panel 1, the pattern layer 4 generates a reflective effect of a ripple luster, thereby increasing the aesthetic feeling of the personal digital assistant (PDA) 50.

Figure 8:
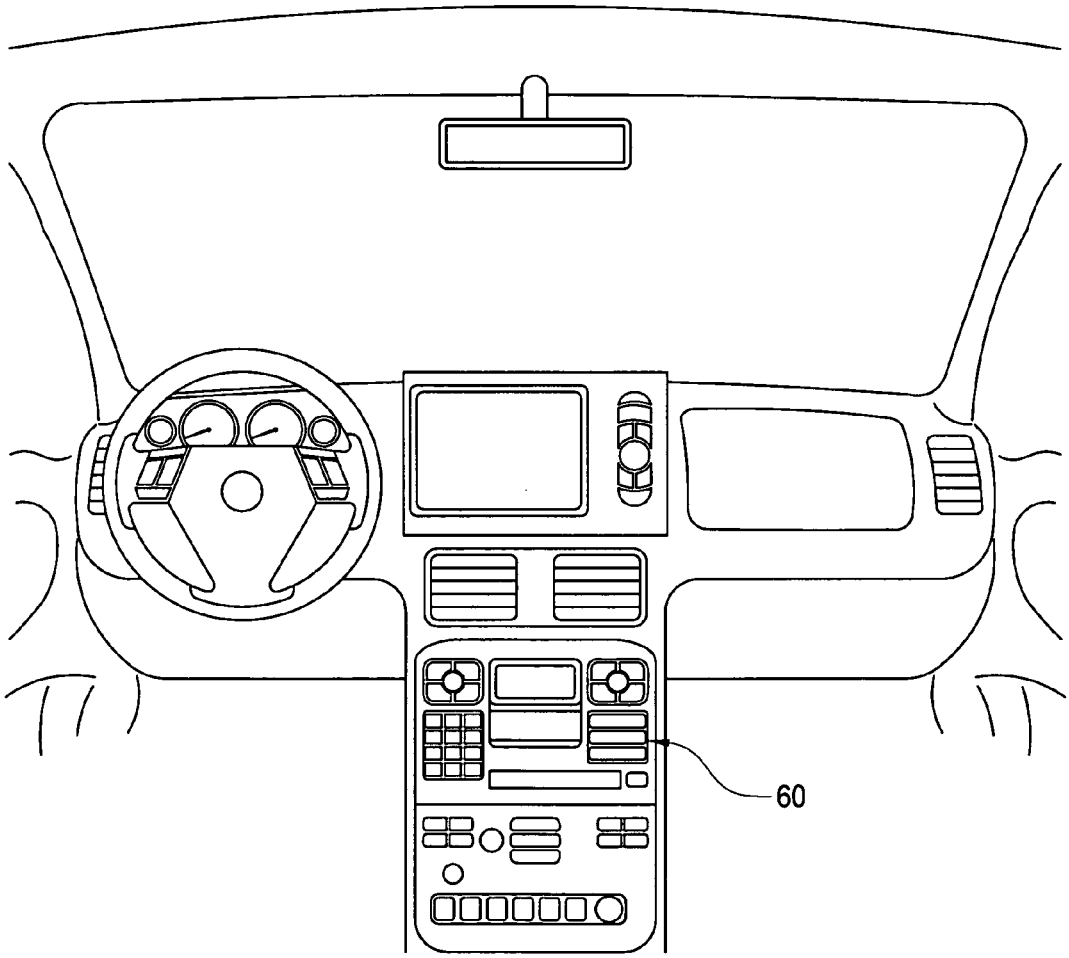
FIG. 8 is a schematic view showing the metallic keypad panel of the present invention being used in an automobile stereo panel.

With reference to FIG. 8, it is a schematic view showing the metallic keypad panel of the present invention being used in an automobile stereo panel. As shown in this figure, in addition to the mobile phone 40 and the personal digital assistant (PDA) 50, the metallic keypad panel of the present invention can be mounted on an automobile stereo panel 60, thereby controlling the operations of an air conditioning system, audio-video system and satellite navigation system.

Further, the electroplated layer 2 can be made according to the demand of the customer. If the customer does not need the electroplated layer 2, the pattern layer 4 can be made directly on one side surface of the metallic keypad panel 1.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. A method for manufacturing a metallic keypad panel having a ripple luster, the metallic keypad panel being arranged on a surface of an electronic device, the method comprising the steps of:

(a) preparing a metallic thin plate;

(b) etching the metallic thin plate so as to form a plurality of hollowed portions on the metallic thin plate;

(c) cutting the metallic thin plate so as to form a keypad panel having a predetermined shape;

(d) disposing the metallic keypad panel in a mold;

(e) injecting a plastic material into the mold to form a pattern layer;

(f) preparing a plastic thin plate;

(g) making a displaying layer on one side surface of the plastic thin plate;

(h) adhering a layer of elastic bodies on one side surface of the displaying layer;

(i) cutting the plastic thin plate to form an elastic layer; and (k) adhering one side surface of the metallic keypad panel on one side surface of the elastic layer, thereby finishing the manufacturing of the metallic keypad panel.

2. The method according to claim 1, wherein the metallic thin plate prepared in the step (a) is made of stainless steel (SUS).

3. The method according to claim 1, wherein the metallic thin plate prepared in the step (a) is made of Al—Mg alloy.

4. The method according to claim 1, wherein the hollowed portions formed in the step (b) comprise a line-type hollowed portion and an icon-type hollowed portion.

5. The method according to claim 4, wherein the line-type hollowed portion is set as a pressing region.

6. The method according to claim 4, wherein the icon-type hollowed portion is set as an icon of the surface of the pressing region.

7. The method according to claim 6, wherein the icons comprise numerals, characters, special symbols, and navigational symbols.

8. The method according to claim 1, wherein an electroplated layer is coated on the surface of the metallic keypad panel prior to the step (d).

9. The method according to claim 8, wherein the electroplated layer is made of a metallic material.

10. The method according to claim 1, wherein a layer of protective film is adhered on either surface of the metallic keypad panel prior to the step (d).

11. The method according to claim 1, wherein the plastic material mentioned in the step (d) is adhered on the surface of the metallic keypad panel or the electroplated layer, so that the pattern on the inner surface of the mold makes the plastic material to form a pattern layer.

12. The method according to claim 11, wherein the pattern layer is any one of a spinning, straight lines or an Archimedean screw.

13. The method according to claim 11, wherein the pattern layer forms a protective layer for the metallic keypad panel.

14. The method according to claim 11, wherein the plastic material is made of transparent thermoplastic polyurethane (TPU) or thermoplastic elastomer (TPE).

15. The method according to claim 1, wherein the plastic thin plate prepared in the step (f) is made of polyethylene terephthalate (PET) or polycarbonate (PC).

16. The method according to claim 1, wherein the displaying layer prepared in the step (g) is constituted of different colors.

17. The method according to claim 1, wherein one side surface of the elastic body mentioned in the step (h) is provided with a plurality of protrusions thereon.

18. The method according to claim 1, wherein the elastic body mentioned in the step (h) is made of a transparent rubber material.

19. The method according to claim 1, wherein the step (k) of adhering the metallic keypad panel and the elastic layer is achieved by an adhesive layer.

* * * * *

UNITED STATES PATENT AND TRADEMARK OFFICE

CERTIFICATE OF CORRECTION

PATENT NO. : 7,735,214 B2
APPLICATION NO. : 11/946584
DATED : June 15, 2010
INVENTOR(S) : Che-Tung Wu It is certified that error appears in the above-identified patent and that said Letters Patent is hereby corrected as shown below:

On the title page, item [73]:

Assignee: Ichia Technoligies, Inc., Taoyuan (TW)

should be

Assignee: Ichia Technologies, Inc., Taoyuan (TW)

"Technoligies" was wrong and --Technologies-- is correct.

Signed and Sealed this
Ninth Day of August, 2011

David J. Kappos

David J. Kappos
*Director of the United States Patent and Trademark Office*